US007353747B2

(12) United States Patent
Swayze et al.

(10) Patent No.: US 7,353,747 B2
(45) Date of Patent: Apr. 8, 2008

(54) ELECTROACTIVE POLYMER-BASED PUMP

(75) Inventors: Jeffrey Swayze, Hamilton, OH (US); Mark Ortiz, Milford, OH (US)

(73) Assignee: Ethicon Endo-Surgery, Inc., Cincinnati, OH (US)

( * ) Notice: Subject to any disclaimer, the term of this patent is extended or adjusted under 35 U.S.C. 154(b) by 316 days.

(21) Appl. No.: 11/161,269

(22) Filed: Jul. 28, 2005

(65) Prior Publication Data

US 2007/0025868 A1 Feb. 1, 2007

(51) Int. Cl.
*F01B 19/04* (2006.01)

(52) U.S. Cl. ..... 92/92; 92/93; 92/105

(58) Field of Classification Search ..... 92/92, 92/93, 105; 417/413.2; 310/339
See application file for complete search history.

(56) References Cited

U.S. PATENT DOCUMENTS 4,344,743 A * 8/1982 Bessman et al. ..... 417/317
6,194,815 B1 * 2/2001 Carroll ..... 310/339
6,376,968 B1 * 4/2002 Taylor et al. ..... 310/339
2005/0040733 A1 2/2005 Goldenberg et al.
2005/0085693 A1 4/2005 Belson et al.

FOREIGN PATENT DOCUMENTS

WO WO-01/06579 1/2001
WO WO-03081762 10/2003
WO WO-2004031582 4/2004

* cited by examiner

*Primary Examiner*—Igor Kershteyn
(74) *Attorney, Agent, or Firm*—Nutter McClennen & Fish LLP

(57) ABSTRACT

Methods and devices for pumping fluid are disclosed herein. In one exemplary embodiment, a pump is provided having a first member with a passageway formed therethrough, and a plurality of electrically expandable actuators in communication with the first member and adapted to change shape upon the application of energy thereto such that sequential activation of the activators can create a pumping action to move fluid through the first member.

25 Claims, 11 Drawing Sheets

ELECTROACTIVE POLYMER-BASED PUMP

BACKGROUND OF THE INVENTION

Pumps play an important role in a variety of medical procedures. For example, pumps have been used to deliver fluids (saline, etc.) to treatment areas during laparoscopic and endoscopic procedures, to transport blood to and from dialysis and heart-lung machines, and to sample bodily fluids for analysis. Most medical pumps are centrifugal or positive displacement pumps positioned outside the surgical field and designed to withdraw or deliver fluid.

Positive displacement pumps generally fall into two categories, single rotor and multiple rotors. The rotors can be vanes, buckets, rollers, slippers, pistons, gears, and/or teeth which draw or force fluids through a fluid chamber. Conventional rotors are driven by electrical or combustion motors that directly or indirectly drive the rotors. For example, peristaltic pumps generally include a flexible tube fitted inside a circular pump casing and a rotating mechanism with a number of rollers (rotors). As the rotating mechanism turns, the rollers compress a portion of the tube and force fluid through an inner passageway within the tube. Peristaltic pumps are typically used to pump clean or sterile fluids because the pumping mechanism (rotating mechanism and rollers) does not directly contact the fluid, thereby reducing the chance of cross contamination.

Other conventional positive displacement pumps, such as gear or lobe pumps, use rotating elements that force fluid through a fluid chamber. For example, lobe pumps include two or more rotors having a series of lobes positioned thereon. A motor rotates the rotor, causing the lobes to mesh together and drive fluid through the fluid chamber.

Centrifugal pumps include radial, mixed, and axial flow pumps. Centrifugal pumps can include a rotating impeller with radially positioned vanes. Fluid enters the pump and is drawn into a space between the vanes. The rotating action of the impeller then forces the fluid outward via centrifugal force generated by the rotating action of the impeller.

While effective, current pumps require large housings to encase the mechanical pumping mechanism, gears, and motors, thereby limiting their usefulness in some medical procedures. Accordingly, there is a need for improved methods and devices for delivering fluids.

BRIEF SUMMARY OF THE INVENTION

The present invention generally provides methods and devices for pumping substances, such as fluids, gases, and/or solids. In one exemplary embodiment, a pump includes a first member having a passageway formed therethrough and a plurality of actuators in communication with the first member. The actuators are adapted to change shape upon the application of energy thereto such that sequential activation of the plurality of actuators is adapted to create pumping action to move fluid through the first member.

The actuators can be formed from a variety of materials. In one exemplary embodiment, at least one of the actuators is in the form of an electroactive polymer (EAP). For example, the actuator can be in the form of a fiber bundle having a flexible conductive outer shell with several electroactive polymer fibers and an ionic fluid disposed therein. Alternatively, the actuator can be in the form of a laminate having at least one flexible conductive layer, an electroactive polymer layer, and an ionic gel layer. Multiple laminate layers can be used to form a composite. The actuator can also include a return electrode and a delivery electrode coupled thereto, with the delivery electrode being adapted to deliver energy to each actuator from an external energy source.

The actuators can also be arranged in a variety of configurations in order to effect a desired pumping action. In one embodiment, the actuators can be coupled to a flexible tubular member disposed within the passageway of the first member. For example, the flexible tubular member can include an inner lumen formed therethrough for receiving fluid, and the actuators can be disposed around the circumference of the flexible tubular member. The pump can also include an internal tubular member disposed within the inner lumen of the flexible tubular member such that fluid can flow between the inner tubular member and the flexible tubular member. The internal tubular member can define a passageway for receiving tools and devices. In another aspect, the actuators can be disposed within an inner lumen of the flexible tubular member and they can be adapted to be sequentially activated to radially expand upon energy delivery thereto, thereby radially expanding the flexible tubular member. As a result, the actuators can move fluid through a fluid pathway formed between the flexible tubular member and the first member.

In another embodiment, multiple actuators can be positioned radially around a central hub within the first member. A sheath can be positioned around the actuators, such that axial contraction of the actuators moves the sheath radially. Sequential movement of the actuators can draw fluid into one passageway and can expel fluid from an adjacent passageway.

Further disclosed herein are methods for pumping fluid. In one embodiment, the method can include sequentially delivering energy to a series of electroactive polymer actuators to pump fluid through a passageway that is in communication with the actuators. In one embodiment, the series of electroactive polymer actuators can be disposed within a flexible elongate shaft, and an outer tubular housing can be disposed around the flexible elongate shaft such that the passageway is formed between the outer tubular housing and the flexible elongate shaft. The series of electroactive polymer actuators can expand radially when energy is delivered thereto to expand the flexible elongate shaft and pump fluid through the passageway. In another embodiment, the series of electroactive polymer actuators can be disposed around a flexible elongate shaft defining the passageway therethrough, and the series of electroactive polymer actuators can contract radially when energy is delivered thereto to contract the flexible elongate shaft and pump fluid through the passageway. In yet another embodiment, the series of electroactive polymer actuators can define the passageway therethrough, and the series of electroactive polymer actuators can radially contract when energy is delivered thereto to pump fluid through the fluid flow pathway.

BRIEF DESCRIPTION OF THE DRAWINGS

The invention will be more fully understood from the following detailed description taken in conjunction with the accompanying drawings, in which.

DETAILED DESCRIPTION OF THE INVENTION

Figure 1A:
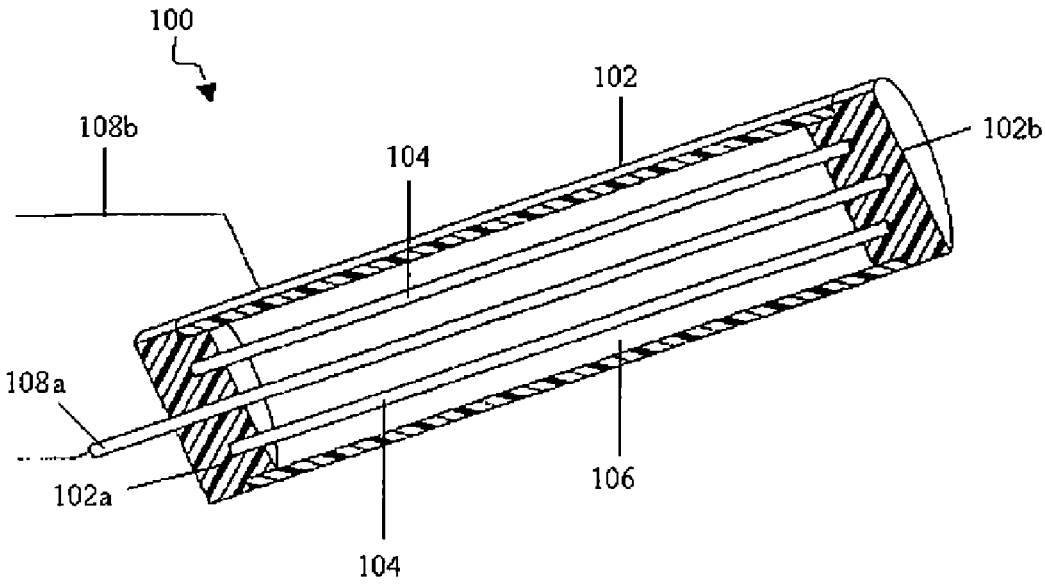
FIG. 1A (PRIOR ART)
FIG. 1A is a cross-sectional view of a prior art fiber bundle type EAP actuator.

Certain exemplary embodiments will now be described to provide an overall understanding of the principles of the structure, function, manufacture, and use of the devices and methods disclosed herein. One or more examples of these embodiments are illustrated in the accompanying drawings. Those of ordinary skill in the art will understand that the devices and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present invention.

Disclosed herein are various methods and devices for pumping fluids. A person skilled in the art will appreciate that, while the methods and devices are described for use in pumping fluids, that they can be used to pump any substance, including gases and solids. In general, the method and devices utilize one or more actuators that are adapted to change orientations when energy is delivered thereto to pump fluid through a fluid pathway in communication with the actuators. While the actuators can have a variety of configurations, in an exemplary embodiment the actuators are electroactive polymers. Electroactive polymers (EAPs), also referred to as artificial muscles, are materials that exhibit piezoelectric, pyroelectric, or electrostrictive properties in response to electrical or mechanical fields. In particular, EAPs are a set of conductive doped polymers that change shape when an electrical voltage is applied. The conductive polymer can be paired with some form of ionic fluid or gel using electrodes. Upon application of a voltage potential to the electrodes, a flow of ions from the fluid/gel into or out of the conductive polymer can induce a shape change of the polymer. Typically, a voltage potential in the range of about 1V to 4 kV can be applied depending on the particular polymer and ionic fluid or gel used. It is important to note that EAPs do not change volume when energized, rather they merely expand in one direction and contract in a transverse direction.

One of the main advantages of EAPs is the possibility to electrically control and fine-tune their behavior and properties. EAPs can be deformed repetitively by applying external voltage across the EAPS, and they can quickly recover their original configuration upon reversing the polarity of the applied voltage. Specific polymers can be selected to create different kinds of moving structures, including expanding, linear moving, and bending structures. The EAPs can also be paired to mechanical mechanisms, such as springs or flexible plates, to change the effect of the EAP on the mechanical mechanism when voltage is applied to the EAP. The amount of voltage delivered to the EAP can also correspond to the amount of movement or change in dimension that occurs, and thus energy delivery can be controlled to effect a desired amount of change.

There are two basic types of EAPs and multiple configurations for each type. The first type is a fiber bundle that can consist of numerous fibers bundled together to work in cooperation. The fibers typically have a size of about 30-50 microns. These fibers may be woven into the bundle much like textiles and they are often referred to as EAP yarn. In use, the mechanical configuration of the EAP determines the EAP actuator and its capabilities for motion. For example, the EAP may be formed into long strands and wrapped around a single central electrode. A flexible exterior outer sheath will form the other electrode for the actuator as well as contain the ionic fluid necessary for the function of the device. When voltage is applied thereto, the EAP will swell causing the strands to contract or shorten. An example of a commercially available fiber EAP material is manufactured by Santa Fe Science and Technology and sold as PANION™ fiber and described in U.S. Pat. No. 6,667,825, which is hereby incorporated by reference in its entirety.

Figure 1B:
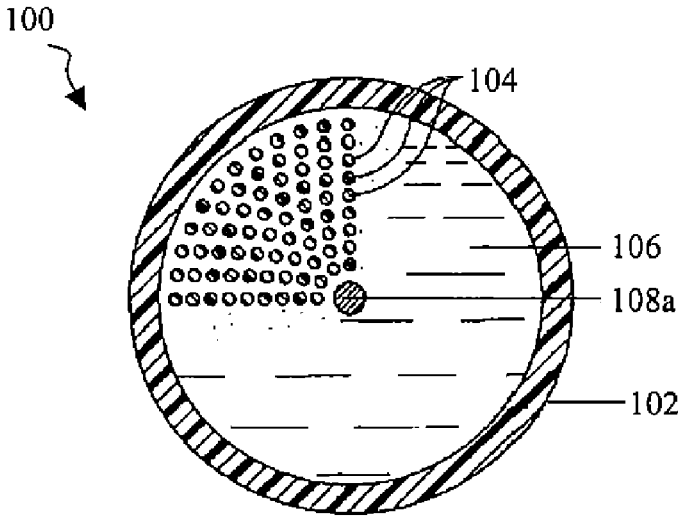
FIG. 1B (PRIOR ART)
FIG. 1B is a radial cross-sectional view of the prior art actuator shown in FIG. 1A.

FIGS. 1A and 1B illustrate one exemplary embodiment of an EAP actuator 100 formed from a fiber bundle. As shown, the actuator 100 generally includes a flexible conductive outer sheath 102 that is in the form of an elongate cylindrical member having opposed insulative end caps 102*a*, 102*b* formed thereon. The conductive outer sheath 102 can, however, have a variety of other shapes and sizes depending on the intended use. As is further shown, the conductive outer sheath 102 is coupled to a return electrode 108*a*, and an energy delivering electrode 108*b* extends through one of the insulative end caps, e.g., end cap 102*a*, through the inner lumen of the conductive outer sheath 102, and into the opposed insulative end cap, e.g., end cap 102*b*. The energy delivering electrode 108*b* can be, for example, a platinum cathode wire. The conductive outer sheath 102 can also include an ionic fluid or gel 106 disposed therein for transferring energy from the energy delivering electrode 108*b* to the EAP fibers 104, which are disposed within the outer sheath 102. In particular, several EAP fibers 104 are arranged in parallel and extend between and into each end cap 102*a,* 120*b.* As noted above, the fibers 104 can be arranged in various orientations to provide a desired outcome, e.g., radial expansion or contraction, or bending movement. In use, energy can be delivered to the actuator 100 through the active energy delivery electrode 108*b* and the conductive outer sheath 102 (anode). The energy will cause the ions in the ionic fluid to enter into the EAP fibers 104, thereby causing the fibers 104 to expand in one direction, e.g., radially such that an outer diameter of each fiber 104 increases, and to contract in a transverse direction, e.g., axially such that a length of the fibers decreases. As a result, the end caps 102*a,* 120*b* will be pulled toward one another, thereby contracting and decreasing the length of the flexible outer sheath 102.

Another type of EAP is a laminate structure, which consists of one or more layers of an EAP, a layer of ionic gel or fluid disposed between each layer of EAP, and one or more flexible conductive plates attached to the structure, such as a positive plate electrode and a negative plate electrode. When a voltage is applied, the laminate structure expands in one direction and contracts in a transverse or perpendicular direction, thereby causing the flexible plate(s) coupled thereto to shorten or lengthen, or to bend or flex, depending on the configuration of the EAP relative to the flexible plate(s). An example of a commercially available laminate EAP material is manufactured by Artificial Muscle Inc, a division of SRI Laboratories. Plate EAP material, referred to as thin film EAP, is also available from EAMEX of Japan.

Figure 2A:
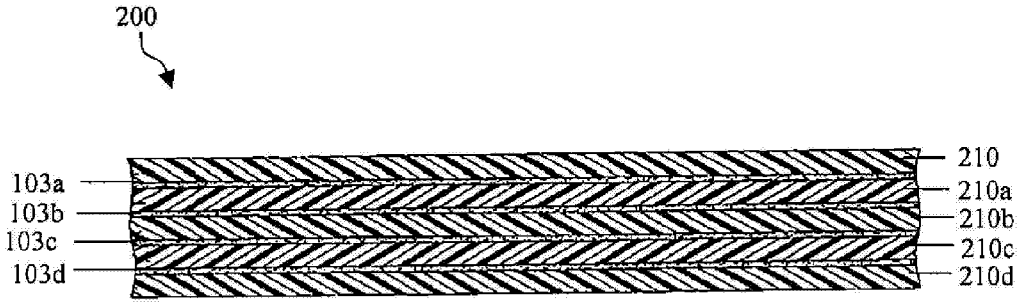
FIG. 2A (PRIOR ART)
FIG. 2A is a cross-sectional view of a prior art laminate type EAP actuator having multiple EAP composite layers.
Figure 2B:
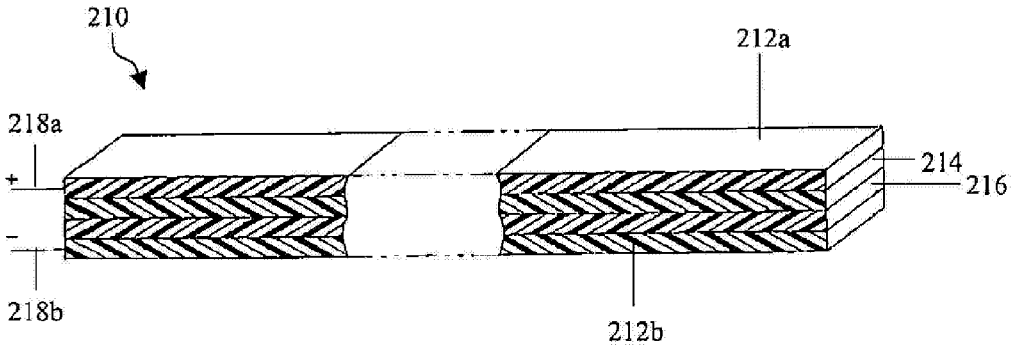
FIG. 2B (PRIOR ART)
FIG. 2B is a perspective view of one of the composite layers of the prior art actuator shown in FIG. 2A.

FIGS. 2A and 2B illustrate an exemplary configuration of an EAP actuator 200 formed from a laminate. Referring first to FIG. 2A, the actuator 200 can include multiple layers, e.g., five layers 210, 210*a,* 210*b,* 210*c,* 210*d* are shown, of a laminate EAP composite that are affixed to one another by adhesive layers 103*a,* 103*b,* 103*c,* 103*d* disposed therebetween. One of the layers, i.e., layer 210, is shown in more detail in FIG. 2B, and as shown the layer 210 includes a first flexible conductive plate 212*a,* an EAP layer 214, an ionic gel layer 216, and a second flexible conductive plate 212*b,* all of which are attached to one another to form a laminate composite. The composite can also include an energy delivering electrode 218*a* and a return electrode 218*b* coupled to the flexible conductive plates 212*a,* 212*b,* as further shown in FIG. 2B. In use, energy can be delivered to the actuator 200 through the active energy delivering electrode 218*a.* The energy will cause the ions in the ionic gel layer 216 to enter into the EAP layer 214, thereby causing the layer 214 to expand in one direction and to contract in a transverse direction. As a result, the flexible plates 212*a,* 212*b* will be forced to flex or bend, or to otherwise change shape with the EAP layer 214.

As previously indicated, one or more EAP actuators can be incorporated into a device for pumping fluids. EAPs provide an advantage over pumps driven by traditional motors, such as electric motors, because they can be sized for placement in an implantable or surgical device. In addition, a series of EAPs can be distributed within a pump (e.g., along a length of a pump or in a radial configuration) instead of relying on a single motor and a complex gear arrangement. EAPs can also facilitate remote control of a pump, which is particularly useful for implanted medical devices. As discussed in detail below, EAPs can drive a variety of different types of pumps. Moreover, either type of EAP can be used. By way of non-limiting example, the EAP actuators can be in the form of fiber bundle actuators formed into ring or donut shaped members, or alternatively they can be in the form of laminate or composite EAP actuators that are rolled to form a cylindrical shaped member. A person skilled in the art will appreciate that the pumps disclosed herein can have a variety of configurations, and that they can be adapted for use in a variety of medical procedures. For example, the pumps disclosed herein can be used to pump fluid to and/or from an implanted device, such as a gastric band.

Figure 3A:
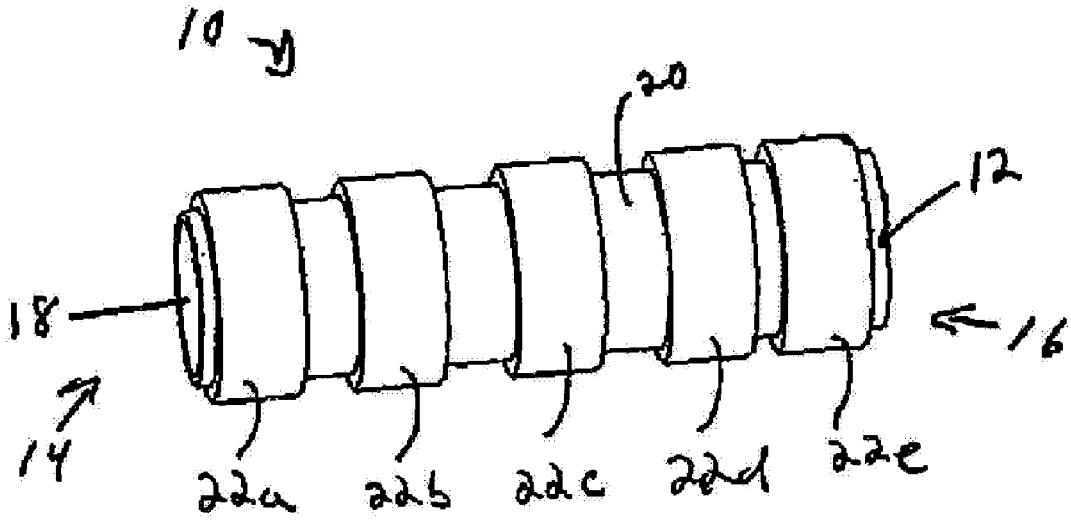
FIG. 3A is a perspective view of one exemplary embodiment of a pump having multiple actuators disposed around a flexible tube.
Figure 3B:
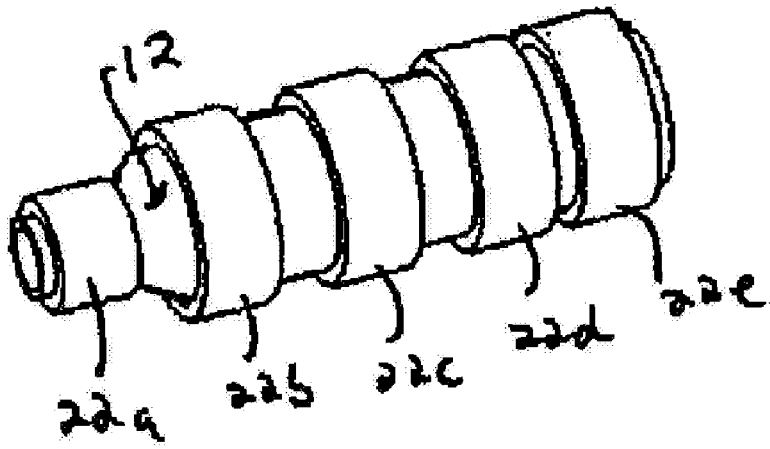
FIG. 3B is a perspective view of the pump of FIG. 3A with the first actuator activated.

FIG. 3A illustrates one exemplary embodiment of a pumping mechanism using EAP actuators. As shown, the pump 10 generally includes an elongate member 12 having a proximal end 14, a distal end 16, and an inner passageway or lumen 18 extending therethrough between the proximal and distal ends 14, 16. The inner lumen 18 defines a fluid pathway. The pump 10 also includes multiple EAP actuators 22*a,* 22*b,* 22*c,* 22*d,* 22*e* that are disposed around the outer surface 20 of the elongate member 12. In use, as will be explained in more detail below, the actuators 22*a*-22*e* can be sequentially activated using electrical energy to cause the actuators 22*a*-22*e* to radially contract, thereby contracting the elongate member 12 and moving fluid therethrough.

The elongate member 12 can have a variety of configurations, but in one exemplary embodiment it is in the form of a flexible elongate tube or cannula that is configured to receive fluid flow therethrough, and that is configured to flex in response to orientational changes in the actuators 22*a*-22*e.* The shape and size of the elongate member 12, as well as the materials used to form a flexible and/or elastic elongate member 12, can vary depending upon the intended use. In certain exemplary embodiments, the elongate member 12 can be formed from a biocompatible polymer, such as silicone or latex. Other suitable biocompatible elastomers include, by way of non-limiting example, synthetic polyisoprene, chloroprene, fluoroelastomer, nitrile, and fluorosilicone. A person skilled in the art will appreciate that the materials can be selected to obtain the desired mechanical properties. While not shown, the elongate member 12 can also include other features to facilitate attachment thereof to a medical device, a fluid source, etc.

The actuators 22*a*-22*e* can also have a variety of configurations. In the illustrated embodiment, the actuators 22*a*-22*e* are formed from an EAP laminate or composite that is rolled around an outer surface 20 of the elongate member 12. An adhesive or other mating technique can be used to attach the actuators 22*a*-22*e* to the elongate member 12. The actuators 22*a*-22*e* are preferably spaced a distance apart from one another to allow the actuators 22*a*-22*e* to radially contract and axially expand when energy is delivered thereto, however they can be positioned in contact with one another. A person skilled in the art will appreciate that actuators 22*a*-22*e* can alternatively be disposed within the elongate member 12, or they can be integrally formed with the elongate member 12. The actuators 22*a*-22*e* can also be coupled to one another to form an elongate tubular member, thereby eliminating the need for the flexible member 12. A person skilled in the art will also appreciate that, while five actuators 22*a*-22*e* are shown, the pump 10 can include any number of actuators. The actuators 22*a*-22*e* can also have a variety of configurations, shapes, and sizes to alter the pumping action of the device.

The actuators 22*a*-22*e* can also be coupled to the flexible elongate member 12 in a variety of orientations to achieve a desired movement. In an exemplary embodiment, the orientation of the actuators 22*a*-22*e* is arranged such that the actuators 22*a*-22*e* will radially contract and axially expand upon the application of energy thereto. In particular, when energy is delivered to the actuators 22*a*-22*e,* the actuators

22*a*-22*e* can decrease in diameter, thereby decreasing an inner diameter of the elongate member 12. Such a configuration allows the actuators 22*a*-22*e* to be sequentially activated to pump fluid through the elongate member 12, as will be discussed in more detail below. A person skilled in the art will appreciate that various techniques can be used to deliver energy to the actuators 22*a*-22*e*. For example, each actuators 22*a*-22*e* can be coupled to a return electrode and a delivery electrode that is adapted to communicate energy from a power source to the actuator. The electrodes can extend through the inner lumen 18 of the elongate member 12, be embedded in the sidewalls of the elongate member 12, or they can extend along an external surface of the elongate member 12. The electrodes can couple to a battery source, or they can extend through an electrical cord that is adapted to couple to an electrical outlet. Where the pump 10 is adapted to be implanted within the patient, the electrodes can be coupled to a transformer that is adapted to be subcutaneously implanted and that is adapted to remotely receive energy from an external source located outside of the patient's body. Such a configuration allows the actuators 22*a*-22*e* on the pump 10 to be activated remotely without the need for surgery.

Figure 3C:
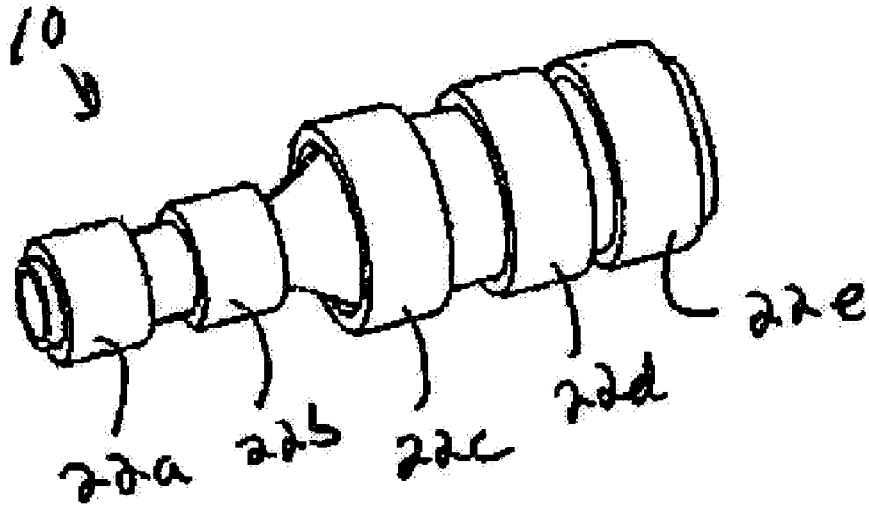
FIG. 3C is a perspective view of the pump of FIG. 3A with the first and second actuators activated.
Figure 3D:
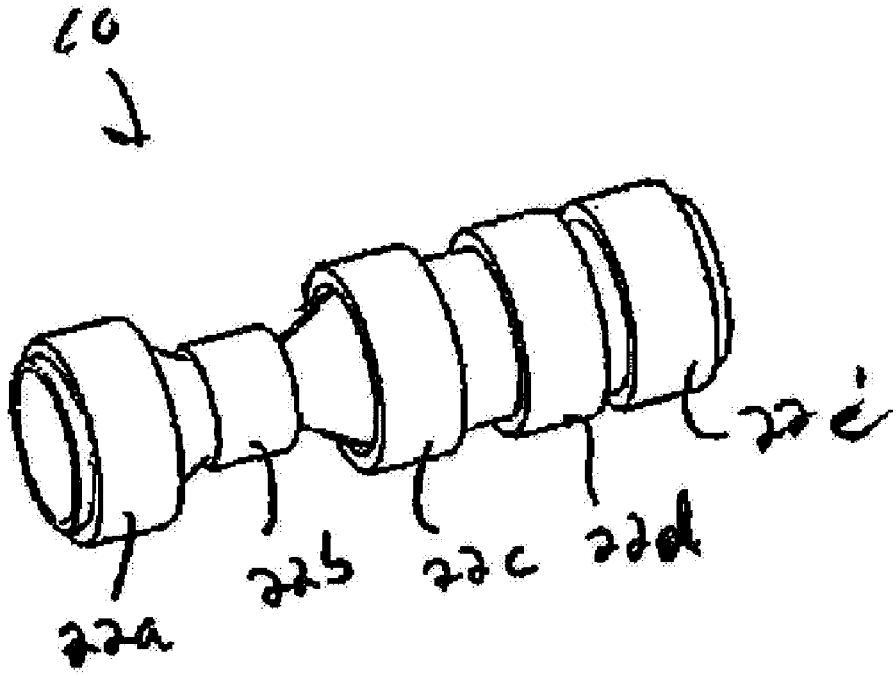
FIG. 3D is a perspective view of the pump of FIG. 3A with the first actuator deactivated and the second actuator activated.
Figure 3E:
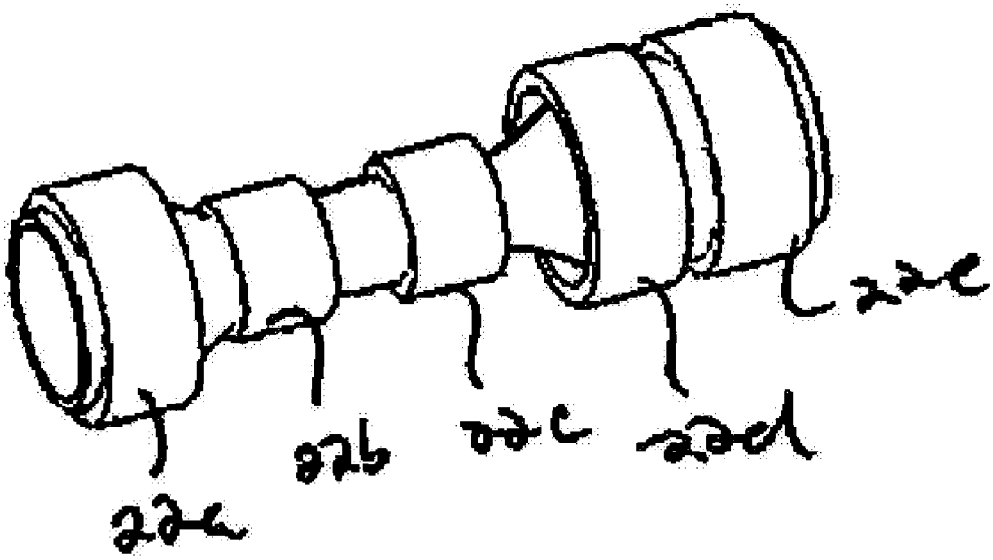
FIG. 3E is a perspective view of the pump of FIG. 3A with the second and third actuators activated.
Figure 3F:
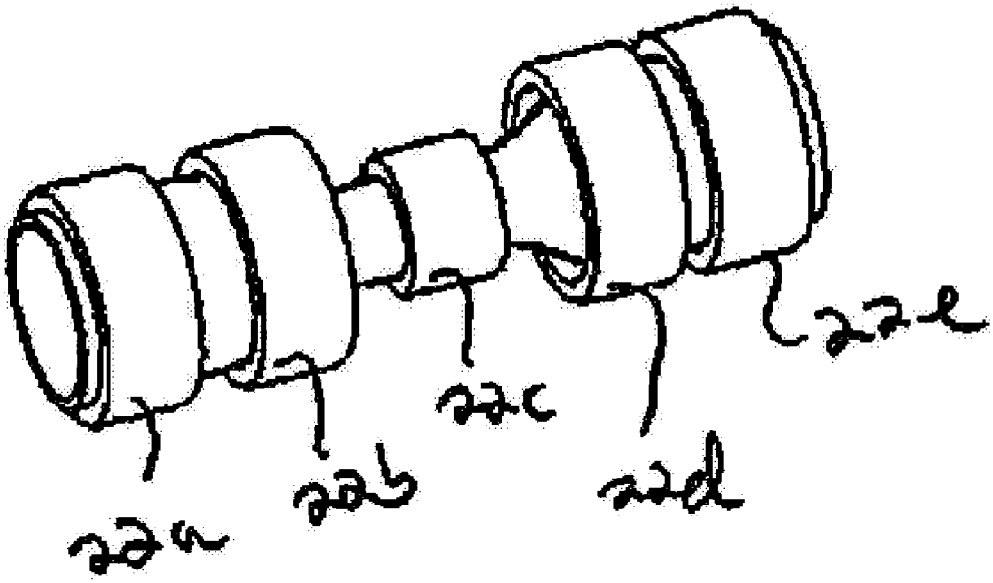
FIG. 3F is a perspective view of the pump of FIG. 3A with the second actuator deactivated and the third actuator activated.
Figure 3G:
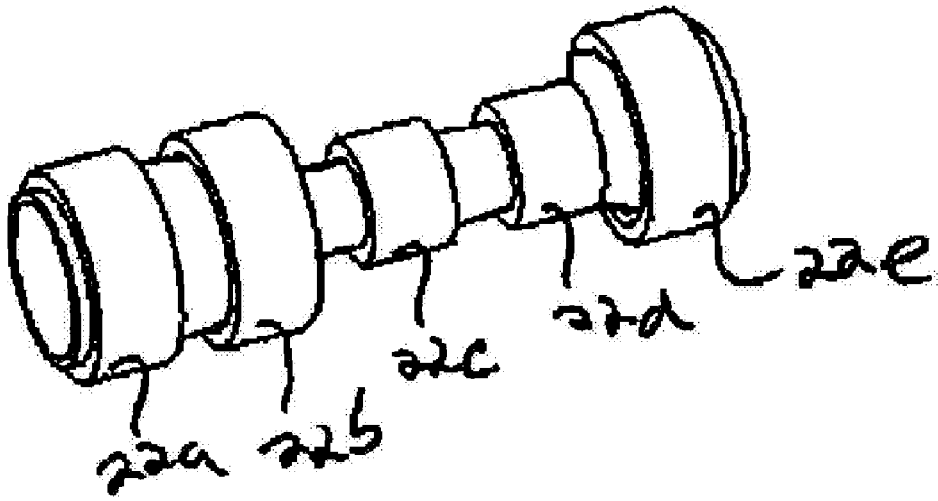
FIG. 3G is a perspective view of the pump of FIG. 3A with the third and fourth actuators activated.

FIGS. 3B-3G illustrate one exemplary method for sequentially activating the actuators 22*a*-22*e* to can create a peristaltic-type pumping action. The sequence can begin by delivering energy to a first actuator 22*a* such that the actuator squeezes a portion of the elongate member 12 and reduces the diameter of the inner lumen 18. While maintaining energy delivery to the first actuator 22*a,* energy is delivered to a second actuator 22*b* adjacent to the first actuator 22*a*. The second actuator 22*b* radially contracts, i.e., decreases in diameter, to further compress the elongate member 12, as illustrated in FIG. 3C. As a result, fluid within the inner lumen 18 will be forced in the distal direction toward the distal end 16 of the elongate member 12. As shown in FIG. 3D, while maintaining energy delivery to the second actuator 22*b,* energy delivery to the first actuator 22*a* is terminated, thereby causing the first actuator 22*a* to radially expand and return to an original, deactivated configuration. Energy is then delivered to a third actuator 22*c* adjacent to the second actuator 22*b* to cause the third actuator 22*c* to radially contract, as shown in FIG. 3E, further pushing fluid through the inner lumen 18 in a distal direction. Energy delivery to the second actuator 22*b* is then terminated such that the second actuator 22*b* radially expands to return to its original, deactivated configuration, as shown in FIG. 3F. Energy can then be delivered to a fourth actuator 22*d,* as shown in FIG. 3G, to radially contract the fourth actuator 22*d* and further pump fluid in the distal direction. This process of sequentially activating and de-activating adjacent actuators is continued. The result is a "pulse" which travels from the proximal end 14 of the pump 10 to the distal end 16 of the pump 10. The process illustrated in FIGS. 3B-3G can be repeated, as necessary, to continue the pumping action. For example, energy can be again delivered to actuators 22*a*-22*e* to create a second pulse. One skilled in the art will appreciate that the second pulse can follow directly behind the first pulse by activating the first actuator 22*a* at the same time as the last actuator 22*d,* or alternatively the second pulse can follow the first pulse some time later.

Figure 4:
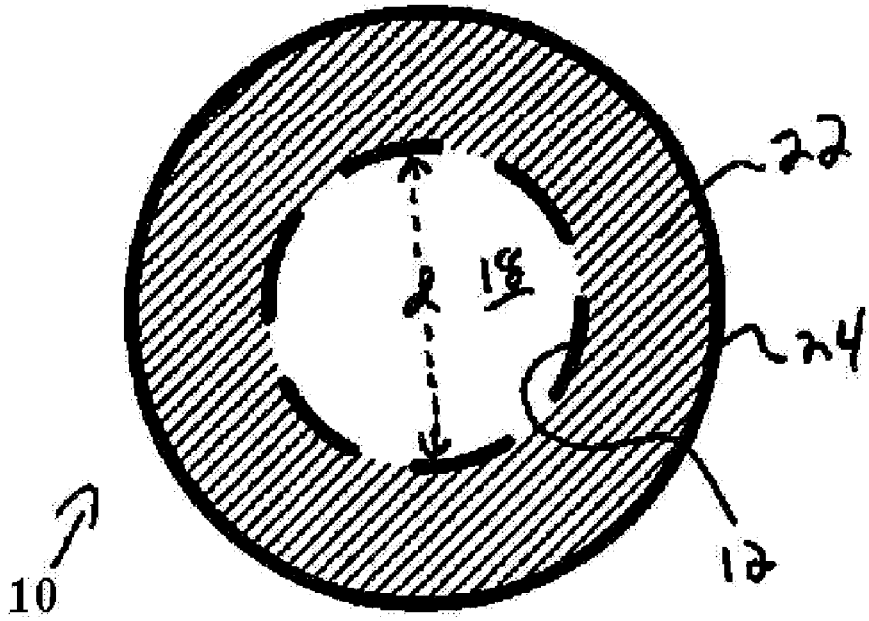
FIG. 4 is a cross-sectional view of another embodiment of a pump having an actuator positioned around the outside of an internal lumen.

In another embodiment, the pump 10 can include an outer elongate member 24 that encloses the inner elongate member 12 and the actuators 22*a*-22*e*. This is illustrated in FIG. 4, which shows a cross-section of pump 10 having an outer elongate member 24 disposed around an actuator 22, which is disposed around the flexible elongate member 12. The outer elongate member 24 can merely function as a housing to enclose the actuators and optionally to provide additional support, rigidity, and/or flexibility to the pump 10.

Figure 5:
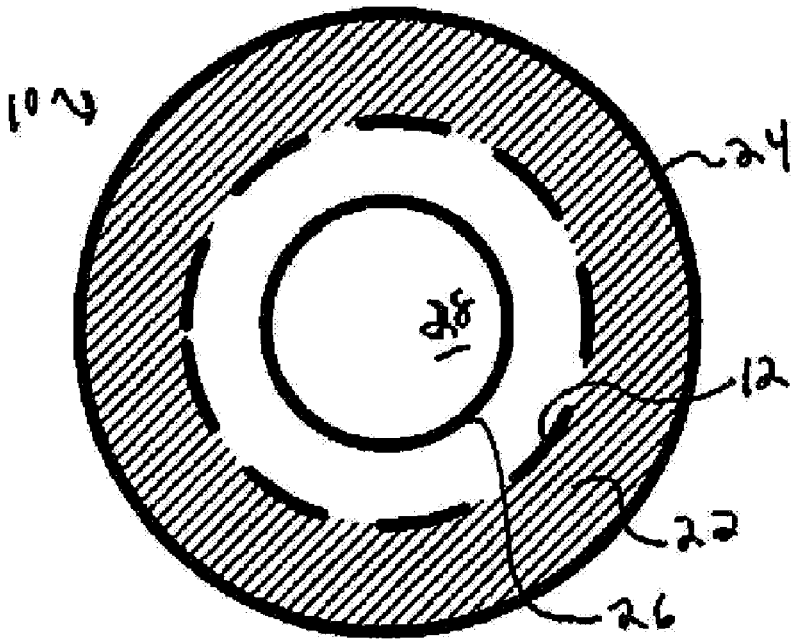
FIG. 5 is a cross-sectional view of another embodiment of a pump disclosed herein including an internal passageway.

In another embodiment, the pump 10 can include additional elongate members and/or passageways. For example, as illustrated in FIG. 5, the pump 10 can include a rigid or semi-rigid internal member 26 that defines an axial passageway 28 through the pump 10. In use, the passageway 28 can provide, for example, access to a surgical site for the delivery of instruments, fluid, or other materials, and/or for visual inspection. While the internal member 26 is illustrated as having a passageway, one skilled in the art will appreciate that it can alternatively be a solid or closed ended member that provides a surface that defines a fluid pathway and/or that provides structural support for pump 10.

Figure 6:
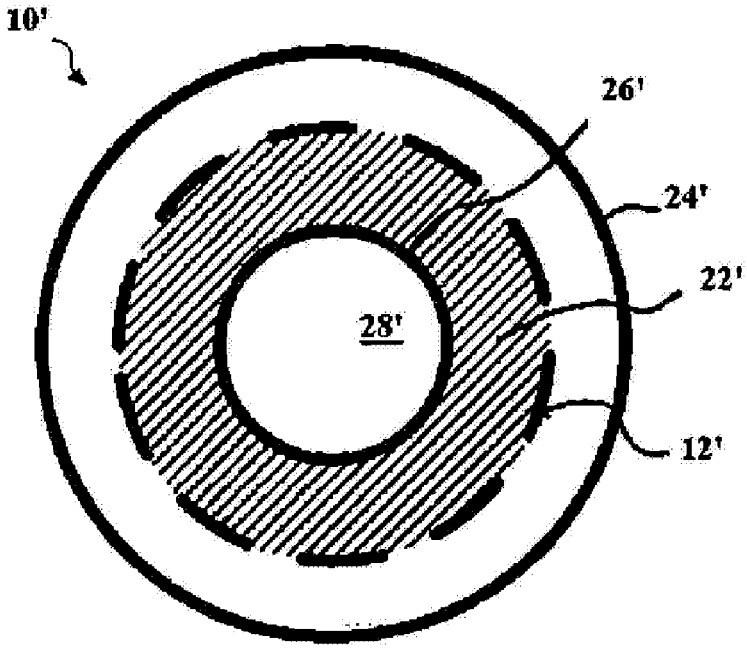
FIG. 6 is a cross-sectional view of yet another embodiment of a pump disclosed herein including an internal passageway.

While the actuators illustrated in FIGS. 3A-5 create pumping action by radially contracting to constrict the elongate member 12, pumping action can alternatively be created by radially expanding the actuator to increase a diameter of an elongate member. For example, FIG. 6 illustrates a cross-sectional view of a pump 10' having an outer elongate member 24' and a flexible inner elongate member 12' that define a fluid flow passageway therebetween. The actuators (only one actuators 22' is shown) are positioned between an internal member 26' and the flexible inner elongate member 12'. The internal member 26' defines a pathway for providing access to a surgical site for the delivery of instruments, fluid, or other materials, and/or for visual inspection. In use, fluid can be pumped through the device 10' by delivering energy to the actuator 22' to radially expand the actuator 22', i.e., increase a diameter of the actuator 22', thereby radially expanding the flexible inner elongate member 12' toward the outer elongate member 24'. One skilled in the art will appreciate that the internal member 26' and/or the outer member 24' of the pump 10' can be flexible, rigid, or semi-rigid depending on the desired configuration of pump 10'.

Figure 7:
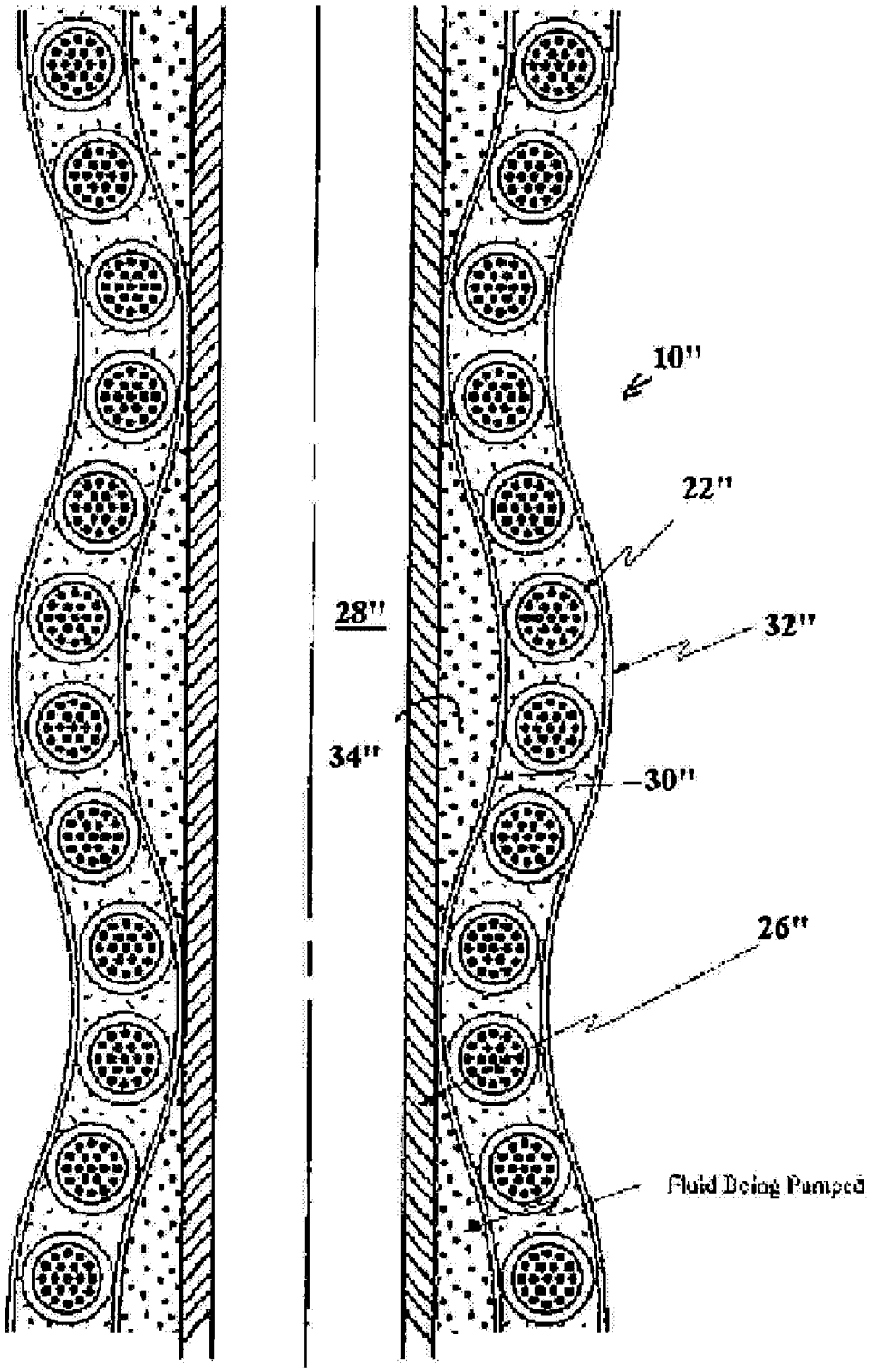
FIG. 7 is a cross-sectional view of another embodiment of a pump disclosed herein.

FIG. 7 illustrates another exemplary embodiment of a pump 10" that utilizes fiber-bundle-type actuators to create pumping action. In particular, the pump 10" can include an elongate member 26" defining a passageway 28" therethrough for providing access to a surgical site for the delivery of instruments, fluid, or other materials, and/or for visual inspection. An inner flexible sheath 30" and outer flexible sheath 32" are disposed around the elongate member 26" and they are spaced a distance apart from one another such that they are adapted to seat the actuators 22" therebetween. In other words, the outer-most flexible sheath 32" can have a diameter that is greater than a diameter of the inner flexible sheath 30". The actuators 22" can be formed into ring shaped members that are aligned axially along a length of the pump 10". In use, fluid can flow between the inner flexible sheath 30" and the elongate member 26". When energy is delivered to an actuator 22", the actuator 22" contracts radially, i.e., decreases in diameter, thereby moving the portion of the inner and outer flexible sheaths 30", 32" that are positioned adjacent to the activated actuator 22" toward the elongate member 26". As previously explained, energy can be sequentially delivered to the actuators 22" to create a pulse-type pumping action.

Figure 8:
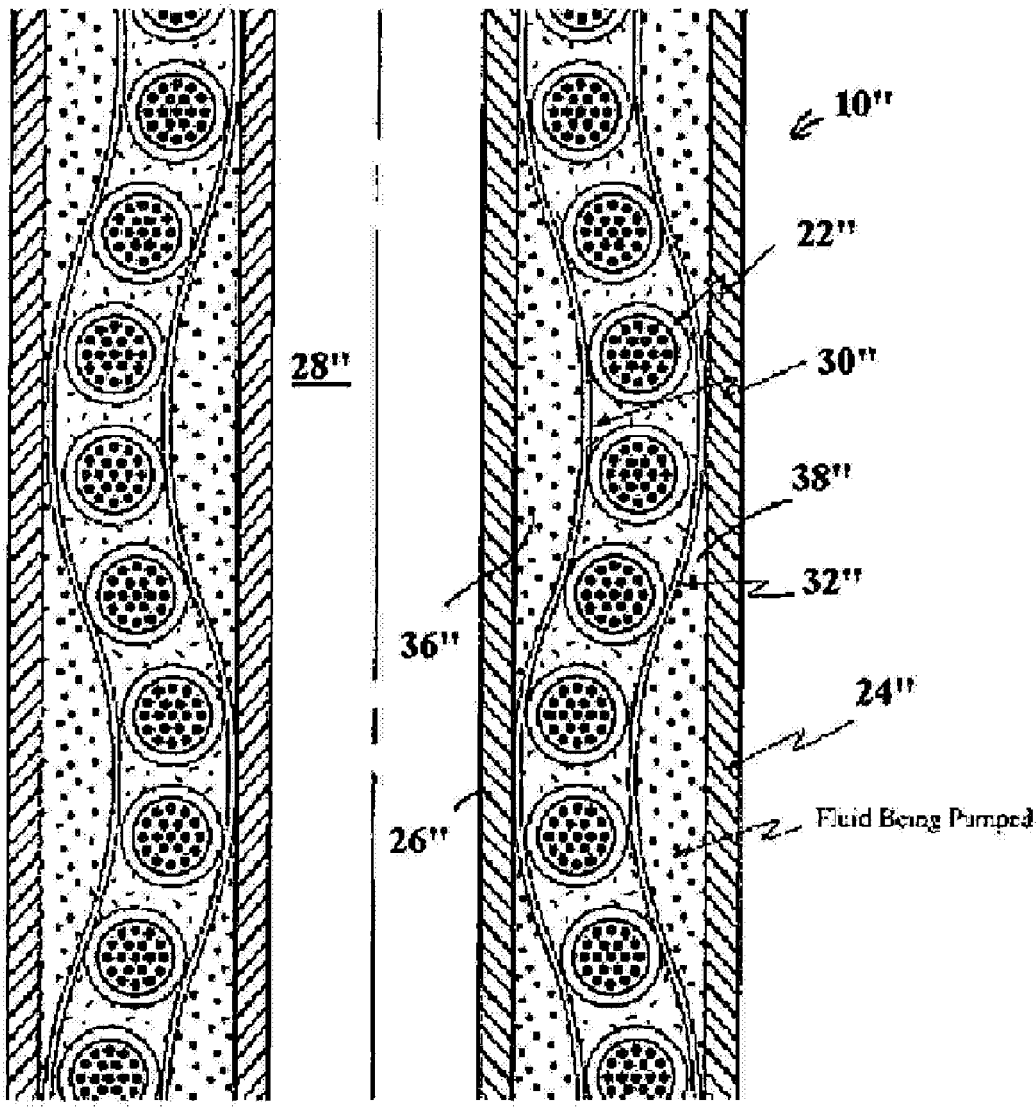
FIG. 8 is a cross-sectional view of still another embodiment of a pump disclosed herein.

As illustrated in FIG. 8, the pump 10" can also include an outer member 24" disposed around the outer sheath 32". The space between the inner sheath 30" and the elongate member 26" can define a first fluid pathway 36" and the space between the outer sheath 32" and the outer member 24" can define a second fluid pathway 38". Sequential activation of the actuators 22" can pump fluid through the first and second pathways 36", 38" simultaneously.

Figures 9A, 9B:
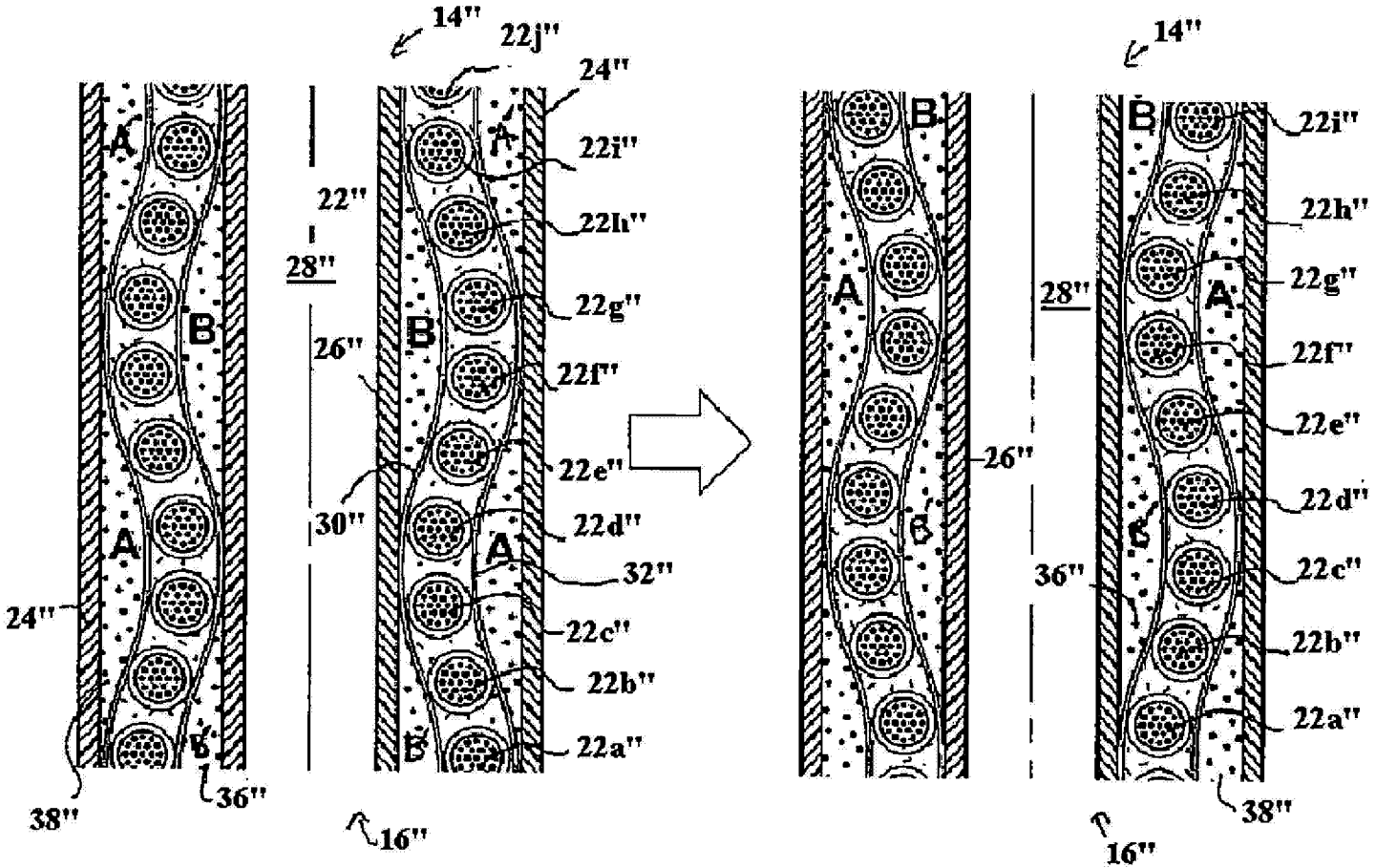
FIG. 9A is a cross-sectional view of the pump of FIG. 8.
FIG. 9B is a cross-sectional view of the pump of FIG. 8.

FIGS. 9A and 9*b* illustrate the pumping action of the actuators 22" in pump 10" of FIG. 8. In general, the actuators 22*a-j*" are sequentially activated to create a wave action. This can be achieved by fully activating some of the actuators, partially activating or partially deactivating adjacent actuators, and fully de-activating some of the actuators. As previously explained, the amount of energy delivered to each actuator can correlate to the amount of radial expansion or contraction that occurs. As shown in FIG. 9A, some of the actuators, e.g., actuators 22*d*" and 22*i*", are fully activated to constrict the inner sheath 30" such that a portion of the inner sheath 30" adjacent to the 22*d*", 22*i*" is positioned against the elongate member 26". Adjacent actuators, e.g., actuators 22*b*", 22*c*", 22*e*', 22*g*", 22*h*", 22*j*", are partially activated or partially deactivated, depending on the desired direction of movement of the fluid, and the remaining actuators, e.g., actuators 22*a* " and 22*f*" are fully deactivated and in a fully expanded configuration. As a result, the actuators 22*a-j*" collectively form a wave configuration along the length of the pump. As energy delivery to each actuator 22*a-j*" continues to shift between fully activated and fully deactivated, the actuators 22*a-j*" will continue to expand and contract, thereby moving fluid through the pathways 36", 38". As shown in FIG. 9B, actuators 22*d*" and 22*i*" are fully deactivated such that they are radially expanded, adjacent actuators 22*b*", 22*c*", 22*e*', 22*g*", 22*h*", 22*j*" are partially activated or partially deactivated, and actuators 22*a* " and 22*f*" are fully activated and in a fully contracted configuration. The actuators 22*a-j*" thus create pressure in the fluid pathways 36", 38" to squeeze the fluid therethrough.

In yet another embodiment, EAP actuators can be used in a lobe or vane type pump. FIGS. 10A-10D illustrate one embodiment of a pump 310 having an outer housing 340 that defines a fluid passageway 341 therethrough, and that includes inlet and outlet ports 350, 352. A central hub 342 is disposed within the outer housing 340 and it includes multiple actuators 322 extending therefrom in a radial configuration. An outer sheath 348 is disposed around the actuators 322 and the hub 342 to form an inner housing assembly. In use, the actuators 322 can be sequentially activated to move the inner housing assembly within the outer housing 340, thereby drawing fluid into pump 310 through the inlet port 350, move the fluid through the pump 310, and expelling fluid through the outlet port 352.

The inner and outer housings can each have a variety of configuration, but in an exemplary embodiment each housing is substantially cylindrical or disc-shaped. The outer housing 340 is preferably formed from a substantially rigid material, while the sheath 348 that forms the inner housing is preferably formed from a semi-rigid or flexible material. The materials can, of course, vary depending on the particular configuration of the pump 310.

The actuators 322 that are disposed within the sheath 348 are preferably configured to axially contract and expand, i.e., decrease and increase in length, to essentially pull the sheath 348 toward the central hub 342, or push the sheath 348 away from the central hub 342. Sequential activation of the actuators 322 will therefore move the inner housing in a generally circular pattern within the outer housing 340, thereby pumping fluid through the outer housing 340. A person skilled in the art will appreciate that the actuators 322 can be configured to axially expand, i.e., increase in length, when energy is delivered thereto, rather than axially contract.

Figure 10A:
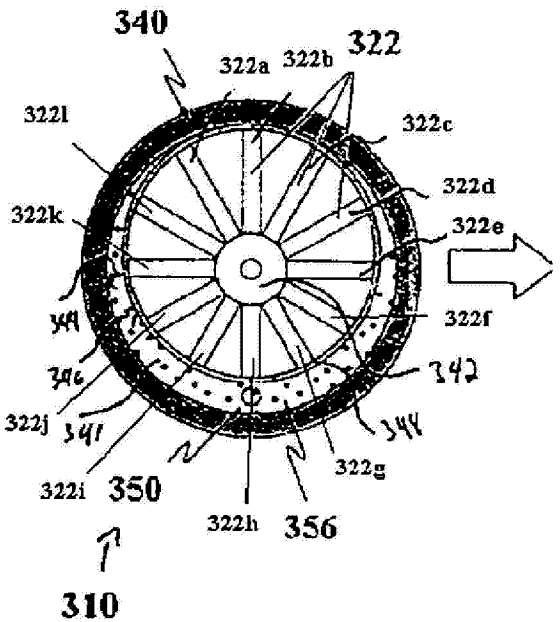
FIG. 10A is a cross-sectional view of another embodiment of a pump disclosed herein.
Figure 10B:
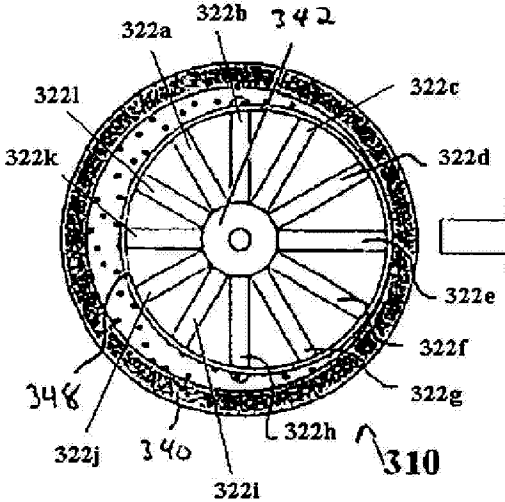
FIG. 10B is a cross-sectional view of the pump of FIG. 10A.
Figure 10C:
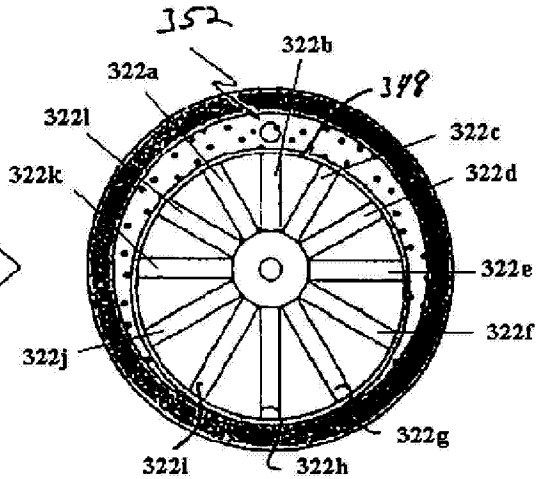
FIG. 10C is a cross-sectional view of the pump of FIG. 10A.
Figure 10D:
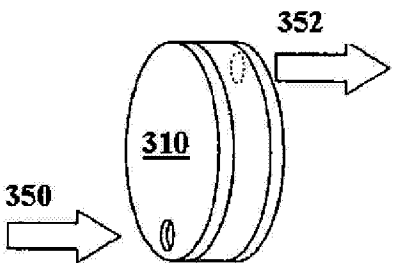
FIG. 10D is a perspective view of the pump of FIG. 10A.

Movement of the inner housing is illustrated in FIGS. 10A-10C. As shown in FIG. 10A, some of the actuators, e.g., actuators 322*f*, 322*g*, 322*h*, 322*i*, and 322*j*, are partially or fully activated (energy is delivered to the actuators) such that they are axially contracted to pull the portion of the sheath 348 coupled thereto toward the central hub 348. As a result, a crescent shaped area is formed within the outer housing 340 into which fluid 356 is drawn. As shown in FIG. 10B, the inner housing assembly is shifted by at least partially deactivating some of the previously activated actuators, e.g., actuators 322*f*, and 322*g*, and by at least partially activating adjacent actuators, e.g., actuators 322*i*, 322*j*, 322*k*, 322*l*, and 322*a*. This sequential activation further moves fluid 356 through the inner volume of outer housing 340. Continued sequential activation of actuators (e.g., 322*l*, 322*a*, 322*b*, 322*c*, 322*d*, 322*e*, etc.) will continue to move fluid 356 toward the outlet port 352, as shown in FIG. 10C. Once fluid 356 is positioned near the outlet port 352, activation of the actuators adjacent to the outlet port 352, e.g., actuators 322*a*, 322*b*, 322*c*, will expel the fluid 356 through the outlet port 352.

One skilled in the art will appreciate further features and advantages of the invention based on the above-described embodiments. For example, the access port can be provided in kits having access ports with different lengths to match a depth of the cavity of the working area of the patient. The kit may contain any number of sizes or alternatively, a facility, like a hospital, may inventory a given number of sizes and shapes of the access port. Accordingly, the invention is not to be limited by what has been particularly shown and described, except as indicated by the appended claims. All publications and references cited herein are expressly incorporated herein by reference in their entirety.

What is claimed is:

1. A pumping device, comprising:

a first member having a passageway formed therethrough;

a central hub disposed within the first member; and a plurality of actuators mated to the central hub and adapted to change shape upon the application of energy thereto such that sequential activation of the plurality of actuators is adapted to create a pumping action to move fluid through the first member.

2. The device of claim 1, wherein each actuator is adapted to expand radially and contract axially upon the application of energy thereto.

3. The device of claim 1, wherein each actuator comprises an electroactive polymer.

4. The device of claim 1, wherein each actuator comprises at least one electroactive polymer composite having at least one flexible conductive layer, an electroactive polymer layer, and an ionic gel layer.

5. The device of claim 1, wherein each actuator includes a return electrode and a delivery electrode coupled thereto, the delivery electrode being adapted to deliver energy to the actuator from an external energy source.

6. The device of claim 1, wherein the plurality of actuators are coupled to a flexible tubular member disposed within the passageway of the first member.

7. The device of claim 5, wherein the plurality of actuators are disposed within an inner lumen of the flexible tubular member, and are adapted to be sequentially activated to radially expand upon energy delivery thereto to move fluid between the flexible tubular member and the first member.

8. The device of claim 1, wherein the actuators are radially positioned within the first member.

9. The device of claim 7, further comprising a sheath positioned around the actuators.

10. The device of claim 9, wherein the actuators are mated to an internal surface of the sheath.

11. The device of claim 9, wherein the application of energy to at least one of the actuators moves the sheath relative to the first member.

12. The device of claim 9, wherein the actuators are adapted to move from a contracted position, in which the sheath is spaced from an inner surface of the first member, to an expanded position in which the sheath contacts the inner surface first member.

13. The device of claim 1, wherein the actuators are adapted to move independently.

14. The device of claim 1, further comprising a fluid inlet and a fluid outlet.

15. A method of pumping fluid, comprising:

sequentially delivering energy to a series of electroactive polymer actuators mated to a central hub to move the central hub and thereby pump fluid through a passageway in communication with the electroactive polymer actuators.

16. The method of claim 15, wherein the central hub is disposed within a housing that defines the passageway, and a sheath is disposed around the actuators and the central hub, and wherein the sheath moves relative to the housing when energy is delivered to the actuators.

17. The method of claim 16, wherein the actuators move from a contracted position, in which the sheath is spaced from an inner surface of the housing, to an expanded position in which the sheath contacts the inner surface housing, when energy is delivered thereto.

18. The method of claim 16, wherein the passageway includes an inlet port and an outlet port, and fluid is pumped through the inlet port and toward the outlet port when energy is delivered to the actuators.

19. The method of claim 16, wherein the sheath moves in a generally circular pattern within the housing when energy is delivered to the actuators, thereby pumping fluid through the passageway.

20. A pumping device, comprising:

an elongate member having first and second pathways formed therethrough;

a plurality of actuators in communication with the elongate member and adapted to change shape upon the application of energy thereto such that sequential activation of the plurality of actuators is adapted to create a pumping action to move fluid through one of the first and second pathways.

21. The pumping device of claim 20, wherein the first pathway is disposed around the second pathway.

22. The pumping device of claim 21, wherein the plurality of actuators are disposed around the first pathway such that the plurality of actuators are adapted to move fluid through the first pathway.

23. The pumping device of claim 20, wherein the plurality of actuators are disposed between the first and second pathways.

24. The pumping device of claim 23, wherein the first pathway is disposed around the plurality of actuators and the plurality of actuators are adapted to pump fluid through the first pathway.

25. The pumping device of claim 20, wherein the plurality of actuators comprise ring-shaped actuators formed from fiber-bundles.

* * * * *